United States Patent [19]

Rosenthal

[11] 4,038,783

[45] Aug. 2, 1977

[54] METHOD AND APPARATUS FOR GENERATING OPTIC LENSES

[76] Inventor: Leon Rosenthal, 7403 Kalton Court, Baltimore, Md. 21208

[21] Appl. No.: 720,370

[22] Filed: Sept. 3, 1976

[51] Int. Cl.[2] ..... B24B 13/00; B24B 1/00

[52] U.S. Cl. ..... 51/33 W; 51/100 R; 51/101 LG; 51/284

[58] Field of Search ..... 51/33 R, 33 W, 50 PC, 51/100 R, 101 LG, 284, 327, 93

[56] References Cited

U.S. PATENT DOCUMENTS

| | | | |
|---|---|---|---|
| 2,290,051 | 7/1942 | Hinkley | 51/33 W |
| 3,239,967 | 3/1966 | Volk | 51/100 R |
| 3,279,126 | 10/1966 | Barron | 51/93 X |
| 3,289,355 | 12/1966 | Coburn | 51/33 R |
| 3,913,274 | 10/1975 | Raiford | 51/284 X |

*Primary Examiner*—Al Lawrence Smith
*Assistant Examiner*—Nicholas P. Godici
*Attorney, Agent, or Firm*—Birch, Stewart, Kolasch & Birch

[57] ABSTRACT

Method and apparatus are provided for grinding ophthalmic lenses by mounting the lens blank on a rotatable pedestal having three additional degrees of freedom on respective orthogonal axes one of which is parallel to the axis of rotation of the mounting pedestal. A grinding wheel is mounted for rotation on an axis parallel to a second of these orthogonal axes and mounted for oscillation in a plane parallel to the third. While the grinding wheel is rotated and oscillated the base and cross radius constraints for the finished lens are superimposed on the lens blank along its axis of rotation and the lens blank pedestal is moving along the second orthogonal axis. This permits the grinding wheel to complete a grind on the blank by traversing only from one outside position to a central position and substantially precludes edge breakage in the blanks.

7 Claims, 4 Drawing Figures

METHOD AND APPARATUS FOR GENERATING OPTIC LENSES

FIELD OF THE INVENTION

This invention relates to the generating of optic lens surfaces and more particularly to generating such surfaces by automatic grinding.

BACKGROUND OF THE INVENTION

There has been a long felt need in the art for apparatus and methods which will permit a wide range of permutations and combinations of lens prescriptions in which substantially infinite varieties of base radius, cross radius, thickness, and prismatic effect are all intertwined by prescription over the recognized range of diopter measurements for ophthalmic lenses.

In addition to the obvious need for such methods and equipment, there is also a crying need in the art to provide grinding equipment which minimizes breakage of lens blanks and astygmatic defects.

Present day equipment is built and installed by experts. Unfortunately, the technicians who operate the equipment to produce prescription lenses are not uniformly as expert as the equipment designers.

With this variation in skill being the rule rather than the exception, present day equipment often produces lenses with untrue radii and unwanted prisms.

Other problems which are encountered in present day equipment are edge breakage, overheating causing breakage under impace tests; softening of lens cement on the lens blanks from high heat of friction, thereby forcing lenses off the mounting blocks and often jamming and damaging the machines as a result.

It is an object of the present invention to provide a new and novel optic lens generating method and apparatus.

Another object of the present invention is to provide a new and novel method and appartus for generating optic lens surfaces utilizing toric type grinding means in conjunction with multiple families of base radius and cross radius templates which cooperate through a novel structure having multiple degrees of constrained movements which effectuate the generation of the desired optical surfaces.

Another object of the present invention is to provide a new and novel optic lens generating method and apparatus which can also be utilized to true up finishing laps which are related to respective families of surfaces to be generated.

Still another object of the present invention is to provide a new and novel optic lens generating method and apparatus which can effectuate a prismatic effect such that the ground lens has a resulting prism in the proper position.

Still another object of the present invention is to provide a new and novel lens generating apparatus in which magazines of templates are utilized to provide a wide range of permutations and combinations of lens prescriptions over the normal range of diopter measurements for prescription lenses.

These and other object of the present invention will become more fully apparent with reference to the following specification and drawings which relate to a preferred embodiment of the present invention.

SUMMARY OF THE INVENTION

Figure 1:
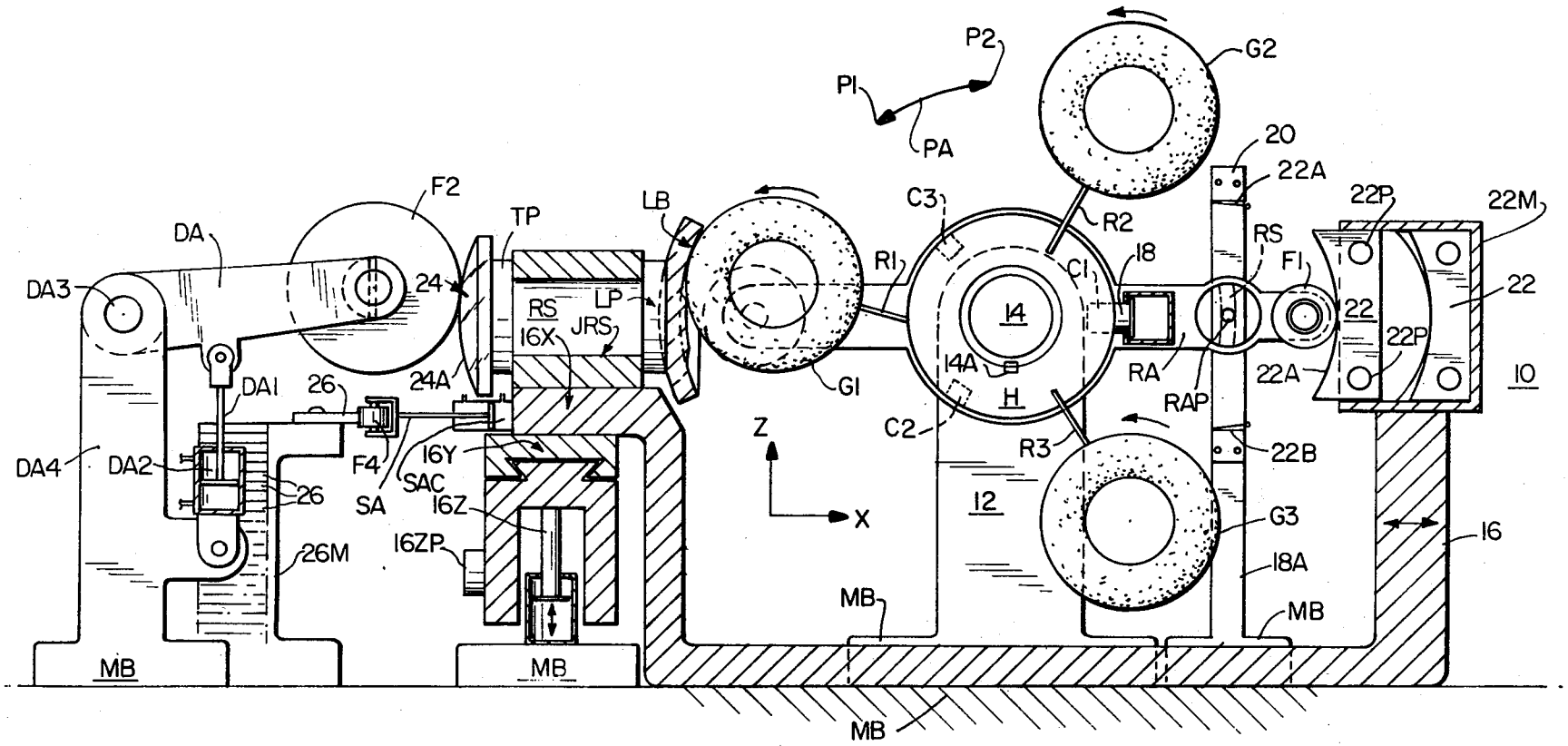
FIG. 1 is a side elevation of a grinding apparatus of the present invention illustrating the toric grinding means, and a side view in partial cross section of a lens blank being operated on by one of the toric grinding means.

The heart of the apparatus of the present invention is a turret having radially extending arms in a vertical plane on which are mounted a plurality of toric grinding wheels having varying speeds of revolution and varying grinding grit values for rough, intermediate and finishing cuts. Mounted adjacent to the turret means, the latter being mounted on a fixed stanchion or the like, is a movable machine element or yoke on which is mounted a magazine of cross radius finishing templates which cooperate with a follower assembly to control the cross radius generating action of the toric grinding wheels on a lens blank which is mounted on the opposite end of the moving machine bed yoke for rotation with respect to said yoke and translation therewith. The end of the machine bed yoke bearing the lens blank to be ground, is referred to as the inboard end of the yoke and the cross radius finishing templates are mounted on the outboard end thereof.

The inboard side of the yoke is mounted for three degrees of freedom in mutually orthogonal X, Y and Z axes with the Z axis being in a vertical plane and the position of the yoke on the Z axis being determined by a suitable hydraulic cylinder or the like. Movement on the X axis will be parallel to the axis of rotation of the lens blanks and the Y axis will be parallel to the axis of rotation of the toric grinding wheels. The three degrees of freedom on the X, Y and Z axes are achieved by machine bed slides and the like as is well known in the art.

The toric grinding wheels are oscillated in a vertical plane about a turret pivot point over a range of movement which is controlled by a pair of micro-switches and control circuitry of a type well known in the art.

During the vertical oscillation of the toric grinding wheel the machine bed yoke translates in the Y axis direction such that the toric grinding wheel moves from a position adjacent one edge of the lens blank to an extreme inboard position at the center of the lens blank at which point the grind is complete. The toric grinding wheel is not permitted to cut completely across the diameter of lens blank so that the toric grinder never engages the far edge of the blank and therefore, does not cause the edge to chip as in the prior art devices. During this translation in the Y axis direction and the oscillation in the vertical plane (i.e., parallel to the Z axis direction) of the toric grinding wheels, the lens blank itself is rotated on an X axis and translated with the yoke in and out along the X axis by a suitable cam actuating device. The cam actuating device follows the surface of a given rough grinding contour lap or template which is affixed to the same shaft or rotating body as the lens blank and which is symmetrically and coaxially mounted at the opposite end of that rotating body or shaft. The rough grinding template or lap determines the base radius or curvature of the ultimate lens to be derived from the lens blank.

After a complete rough grinding cut has been made by a toric grinding wheel having the proper abrasive characteristics, the lens blank is shifted back to its starting position in which its action is controlled with respect to the proper toric grinding wheel having a finish grit or abrasive quality by a magazine of finishing laps or templates for the base radius as well as finishing templates for the cross radius. In this operating mode, during the finishing grind, the lens blank is not rotated on the X axis but is maintained stationary such that the toric grinder aside from its own oscillation and rotation does an orthogonal surface scan of the lens blank as constrained by the base and cross radius templates to effect a finished and polished surface thereon.

Therefore, it can be readily seen that the initial or rough cut achieved by the present invention is accomplished by a complex multiple motion between the toric grinding wheels the lens blank and the machine bed such that there are six degrees of freedom exercised in achieving the rough grind.

DETAILED DESCRIPTION OF THE DRAWINGS

Referring in detail to the drawings and with particular reference to FIGS. 1 and 2, the lens grinding and generating apparatus generally designated by the numeral 10 will now be described. As best shown in FIG. 1, there is an upright stanchion or support 12 in which is journalled a horizontal shaft 14 which is perpendicular to the upright stanchion 12 and on which is mounted a hub H on which a plurality of radial arms R1, R2 and R3 are shown schematically.

On the outboard ends of the arms R1, R2 and R3 are located a plurality of toric grinding wheels G1, G2 and G3 respectively. These grinding wheels G1, G2 and G3 are of respectively varying degrees of grit or abrasive quality and have their axes of rotation horizontally disposed i.e., parallel to the axis of rotation of the shaft 14 to which the hub H is keyed at 14A.

Figure 2:
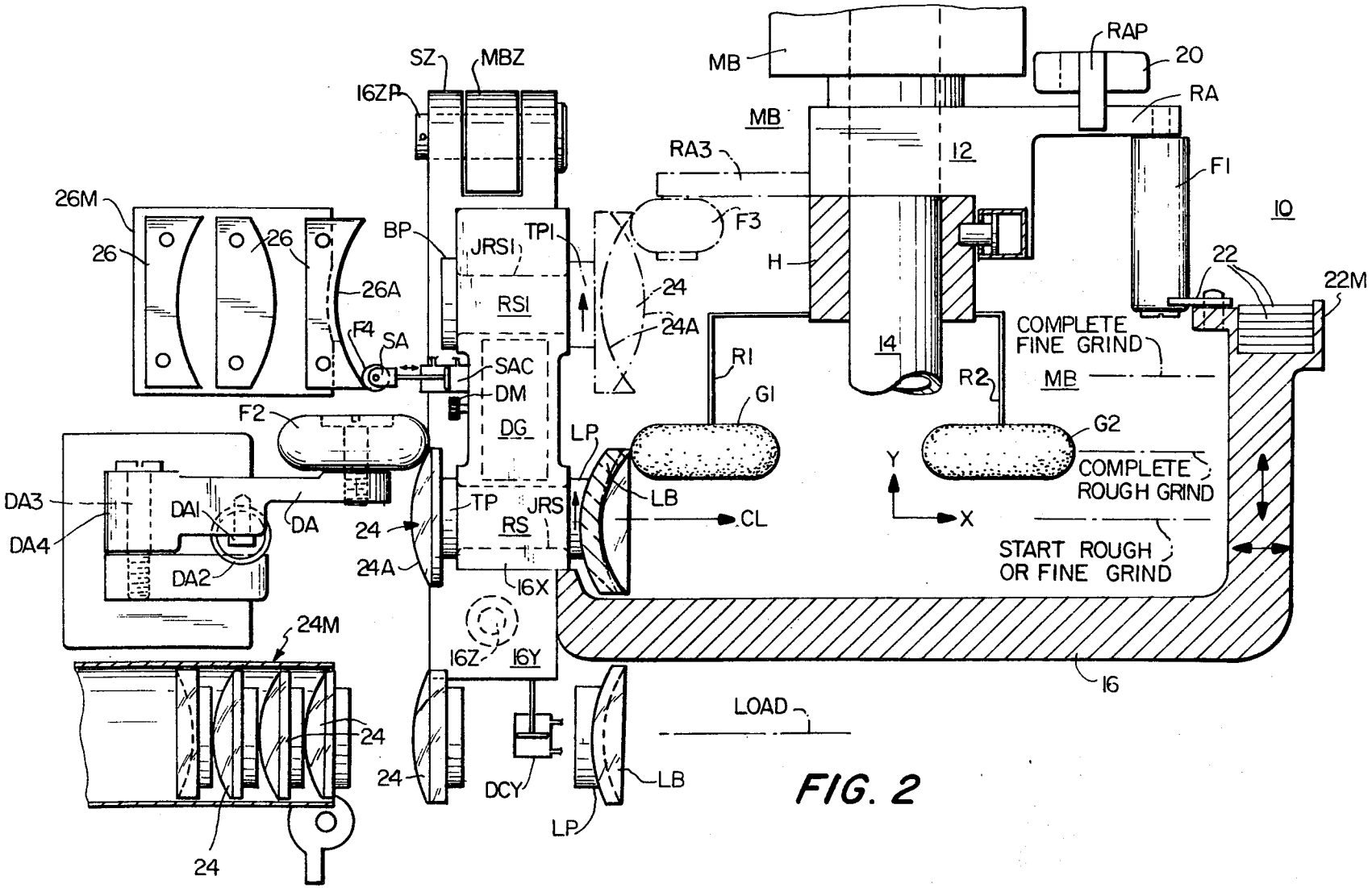
FIG. 2 is a top plan view in partial cross secton of the apparatus of FIG. 1.

The stanchion 12 is fixed to a given point on a machine bed MB schematically indicated as a fixed or solid portion beneath a U-shaped travelling machine yoke 16, the yoke 16 is shown as being U-shaped in partial cross section in both FIGS. 1 and 2 and thus is, in reality, in the configuration of an open side rectangular box or angular shroud. For the sake of schematic simplicity, however, the machine yoke 16 is shown as a basically U-shaped figure in both FIGS. 1 and 2 such that it is illustrated in both of these figures in partial cross section.

The yoke 16 includes an X axis slide portion 16X a Y axis slide portion 16Y and a Z axis actuating plunger 16Z the latter being shown in FIG. 1. All of the slides 16X, 16Y and 16Z are interconnected machine bed slides orthogonally disposed one with respect to the other as is well known in the art. Because the vertical movement (Z axis) is relatively small, the Z axis slide SZ is mounted to a pivot pin 16ZP which is maintained in an upstanding stanchion MBZ on the machine bed MB as best illustrated in FIG. 2. The hub H is provided with radial indexing cavities C1, C2 and C3 which respectively are adapted to position the radial arms R1, R2 and R3 and their respective grinding wheels G1, G2 and G3 in diameter opposition to the said indexing cavities by means of a retractable hydraulic latching plunger 18. The plunger 18 also serves as a pressure applying and compensating device which is coaxially disposed within a radial arm RA which is contrained by a pivot-like pin RAP to move within an arcuate slot RS in a vertical stanchion or standard 20 between first and second extreme positions determined by first and second or top and bottom microswitch means 22A and 22B respectively.

Outboard of the traveling pivot RAP is a first cam follower roller F1 which engages the standard curvature comprising the face 22A of a standard cross radius finishing template oriented in a vertical plane parallel to the Z axis and orthogonally disposed to the axis of rotation of the grinding wheels G1, G2 and G3. These cross radius finishing templates 22 are contained in a magazine 22M which can house as many as 160 of such templates, all in a two dimensional sheet cam form, to cover a range of ophthalmic diopter values which are approximately 160 in number for the cross radius dimensions of ophthalmic lens. The magazine 22M and the standard cross radius templates 22 are all mounted in the outboard end of the machine yoke 16 and are engaged by first the follower roller F1 through the arm RA as the shaft 14 is oscillated back and forth between extreme positions P1 and P2 indicated by the arcuate arrow PA at the upper portion of FIG. 1, the distance P1-P2 being determined by the separation between the two micro switches 22A and 22B which control a suitable reversible motor, not shown, which is driving the shaft 14 on which the turret H has been keyed.

Therefore, the grinding wheels G1, G2 and G3 are oscillated and rotated by suitable known means (not shown) in the vertical plane parallel to the Z axis and the Z axis actuating plunger 16Z (the X-Z plane) over a given peripheral oscillation distance P1-P2 which coincides with the size of a lens blank LB to be ground by the various grinding wheels G1, G2 and G3.

The lens blank LB is mounted on a suitable pedestal LP which in turn is coaxially disposed with a rotary shaft RS which is journaled through a suitable journal bearing JRS integral with the top of the X axis machine slide 16X.

At the opposite of the rotary shaft RS is coaxially mounted a template or lap mounting plate TP on which a template 24 is mounted exposing a standarized base-radius determining surface 24A for the lens blank LB towards the rear of left side, as shown, of the X axis slide 16X.

The standarized base-radius surface 24A is engaged by a second cam follower roller or wheel F2 which is mounted on the outer end of an oscillating driver arm DA which is oscillated in a vertical plane parallel to the X-Z plane by means of an intermediate crank arm DA1 driven from a hydraulic cylinder DA2 and an end pivot DA3 on a vertical stanchion DA4 which is mounted to the machine bed MB as are the turret stanchion 12 and vertical standard 20.

The standard laps or templates 24 for the base-radius curves are taken from a magazine 24M shown schmatically in FIG. 2, which magazine 24M also may include as many as 160 templates to cover the standard incremental range of diopters for ophthalmic lens prescriptions.

The rotary shaft RS carrying the lens blank LB is rotated by means of a drive gear DG and a driving means DM of the type well known in the art which tends to rotate the lens blank in the direction of the arrow shown on the lens mounting pedestal LP. The rotary shaft RS and the lens blank LB are rotated during the course or rough grinding step of the present invention as will be hereinafter more fully described.

At the opposite end of the X axis slide 16X is mounted another rotating shaft RS1 in another journal JRS1 which mounts another template holding pedestal TP1 at a position facing the grinding wheel G1, G2 and G3. As shown in phantom lines in FIG. 2, the template pedestal TP1 can carry one of the standarized templates or laps 24 with the standard curve face 24A thereof facing towards the hub H such that it is engageable by a third follower roller F3 or the like mounted on a radial arm RA3 which is integral with the arm assembly RA previously described with respect to FIG. 1 and diametrically opposed thereto.

As shown in solid lines in FIG. 2 the rear face of the slide 16X merely carries an enlarged platen BP which serves as a bearing plate to retain the rotary shaft RS1 in the journal JRS1, there being no template or the like on the rear end of the rotary shaft RS1.

Immediately adjacent the bearing plate BP is a fourth follower roller F4 which is mounted on a control arm SA extending from a drive cylinder SAC on the X axis slide 16X such that the fourth follower roller F4 engages a standarized face 26A of a fine-grind base-radius finishing template 26, a plurality of such templates 26 being included in a base-radius finishing template magazine 26M and being present in same number, namely, 160 incremental templates, that cover the base-radius diopter range for ophthalmic lenses.

Also, as shown in FIG. 2 there is a hydraulic drive cyclinder DCY which drives the Y axis machine slide 16Y in a Y axis direction as illustrated by the arrows adjacent to the cylinder DCY in FIG. 2.

Also, as illustrated by the schematic axes diagrams, FIG. 1 is in the XZ plane and FIG. 2 is in the XY plane with respect to the X, Y and Z axes.

It is to be understood that when the X, Y and Z axes of motion are spoken of is is with regard to parallel senses of direction and not to any given particular line in space except as it effects the lens blanks within the confines thereof during grinding.

Figure 3:
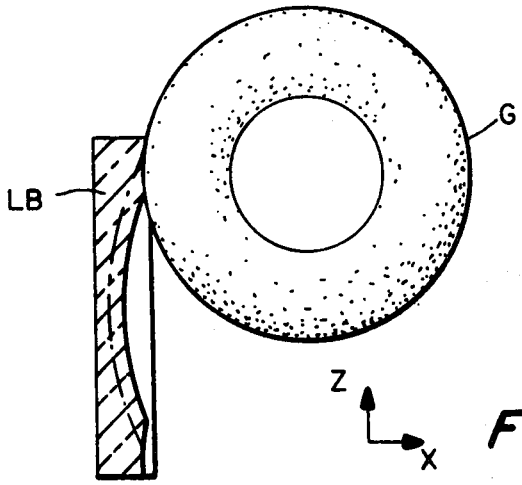
FIG. 3 is an enlarged detail in schematic form of the vertical swing and material removal achieved by a toric grinding element of the present invention.
Figure 4:
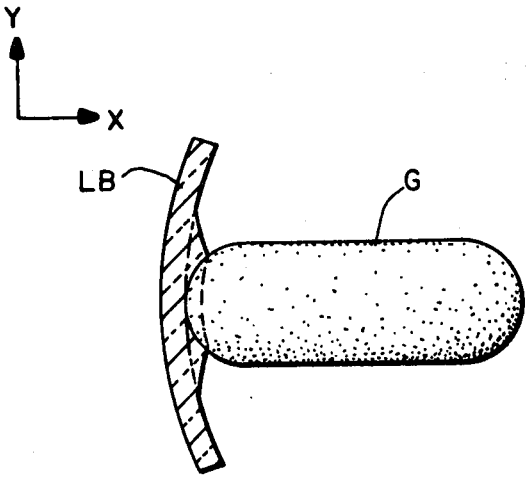
FIG. 4 is a top plan view illustrating schematically the removal of material from a lens blank in a horizontal path by a toric grinding means of the present invention.

The action of the grinding wheels G generically illustrated in FIGS. 3 and 4 in representation of either of the grinding wheels G1, G2 or G3, is shown as removing material from the lens blank LB in the XZ and XY planes, respectfully. The width of cut is also illustrated and is on the order of magnitude of 0.006 inches, thereby materially reducing friction and resulting heating of the lens blank to substantially eliminate breakage due to heat distortion, stress and mounting cement deterioration.

OPERATION OF THE INVENTION

Referring jointly to FIGS. 1, 2, 3 and 4 and assuming that the first or rough-cut is made by the grinding wheel G1 which would therefore be of the coarsest abrasive quality of a'l of the grinding wheels, the proper cross radius template 22 is selected from the magazine 22M and mounted on pins 22P on the outermost tip of the machine yoke 16 in immediate proximity to the first follower roller F1.

The drive cylinder DCY for the Y axis slide 16Y is then indexed by any suitable mechanism of the type well known in the art to the position indicated as the LOAD position for the machine yoke 16, in which position a selected standard base-radius template 24 is selected from the magazine 24M and is either concave or convex depending upon the type of surface desired.

In the case of a concave surface to be ground into the lens blank LB than a convex template 24 is selected and placed on the shaft RS and platen TP. In the event that a convex surface is to be ground upon a lens blank LB such as might be desired, then a concave template 24 is placed upon the template mounting platen TP1 on the rotary shaft RS1 shown in phantom lines of the upper portion of FIG. 2 where it would be followed by the third follower roller F3 on the radius arm RA3.

The operation of the invention will be described however with respect to the grinding of a concave surface on a lens blank LB which will therefore be controlled through the rotary shaft RS and the X and Y slides 16X and 16Y by means of a rotating convex template 24 which cooperates with the second follower roller F2 driven by the drive arm DA and the hydraulic cylinder DA2 as previously described.

Once all of the respective components required to grind the lens are positioned, the machine yoke 16 is shifted by means of the Y slide 16Y from the LOAD position to the START ROUGH or FINE GRIND position in which the center line CL of the lens blank LB is positioned coincident with the START ROUGH or FINE GRIND position and the outer periphery of the lens blank LB is juxtaposed with the central periphery of the rough grind roller G1.

The drive means DM is energized to rotate the driving gear DG which drives the rotary shaft FS to rotate the lens blank LB and the toric grinding wheel G1 is rotated by any suitable means well known in the art on the turret H; and the turret H is oscillated by a driving motor, not shown, via the shaft 14 and controlled by the limit switches 22A and 22B in accordance with a previous adjustment of the Z axis actuating rod 16Z which has properly positioned the lens blank LB with respect to the grinding wheel G1 in the Z axis of FIG. 1.

With the toric grinding wheel G1 rapidly rotating and oscillating about the axis of the shaft 14 between the limits P1 and P2 as illustrated by the arrow PA in FIG. 1, the machine yoke 16 is driven back and forth along the X axis in response to the action of the first follower roller F1 on the cross-radius template face 22A of the cross radius template 22. This causes the X axis slide 16X to move reciprocally along the X axis direction of motion in coordination with the oscillation between limits P1 and P2 of the grinding wheel G1 such that the desired cross-radius curvature in the lens blank LB is followed by the grinding wheel G1.

Simultaneously, the lens blank LB is rapidly rotating and the Y slide 16Y is progressively moving from the START ROUGH or FINE GRIND position to the COMPLETE ROUGH GRIND position such that the second follower roller F2 is additionally providing an X axis constraint onto the lens blank LB and the X axis slide 16X such that the base-radius curvature constraint is provided through the base radius template 24.

Since the grinding wheel G1 is only moved from the initial contacting edge of the lens blank LB into the center thereof, by the completion of the START ROUGH GRIND to COMPLETE ROUGH GRIND translation between the two so-designated positions, the grinding wheel G1 never drags across a trailing edge of the lens blank LB and is always seen as grinding from the outside in, thereby precluding chipping and cracking of the lens blank LB in the rough grind mode. Furthermore, because of the rotation of the lens blank LB and the compound motions achieved in the machine yoke 16 by both the template 24 and the template 22 which establish the base and cross-radius diopter characteristics of the lens, respectfully, only half of the lens distance diameter need be traversed in order to make a complete rough grind of the desired lens surface.

At this point and time, the locking hydraulic device 18 is actuated to release the hydraulic piston therein from the latching cavities C1 and the turret H is rotated on a shaft 14 until such time that either the latching cavity C2 or the latching cavity C3 is engaged by the hydraulic latching device 18 in order that an intermediate finish grinding wheel G2 or the final polishing grinding wheel G3 is juxtaposed with the lens blank LB which has now been rough ground.

The Y axis slide 16Y is now returned to the START ROUGH or FINE GRIND position by the drive cylinder DCY and either the wheel G2 or the grinding wheel G3 are now juxtaposed with the leading edge of the roughly ground lens blank LB. At this point and time, the drive means DM and the drive gear DG are deenergized and locked such that the lens blank LB is fixed with respect to the axis RS on which it is mounted and therefore, only an XY type of surface scan (an orthogonal surface scan) is possible with one of the finer grinding wheels G2 and or G3.

The drive cylinder DCY is then actuated to commence a gradual traverse of the lens blank from the START ROUGH or FINE GRIND position through the COMPLETE ROUGH GRIND position to the COMPLETE FINE GRIND position which completely traverses a full diameter of the lens blank LB without permitting the toric grinding wheel G2 or G3 from passing beyond the trailing edge of the lens blank to thereby preclude any cracking or chipping thereof.

The base-radius curve in the fine or intermediate grinding configuration is now controlled by the standard template 26 in the fine-dimension base-radius template magazine 26M operated through the fourth follower roller F4 to move the X axis slide 16X via the control arm SA and drive cylinder SAC in accordance with the proper configuration of the base-radius curve of the lens blank LB. This of course is accomplished by traverse of this template by the Y axis slide 16Y as constrained by the drive cylinder DCY.

During the FINE GRIND or FINISH GRIND of the lens blank LB the X axis variations are constrained by the finish-dimension base-radius templates 26 and the cross-radius is superimposed thereon by the cross-radius templates 22 which act in conjunction with the oscillation of the final or intermediant grinding wheels G3 or G2 respectively, as the case may be, to complete an orthogonal coordinate scan of the surface of the nonrotating lens blank LB in the final or intermediate grinding modes of the present invention.

In order to grind a lens with a vertical prism included in the prescription, for example, the lens blank LB is decentrated, i.e., raised or lowered by the vertical actuator 16Z which raises the slides SZ, YZ and XZ and the shaft RS such that the desired prism is effectuated during the grinding operations on the lens blank LB. Horizontal prisms are also effectuated by similar means.

As can readily be seen from the foregoing specification and drawings, the present invention satisfies a long felt need in the art for a reliable and accurate ophthalmic lens grinding apparatus and method which will substantially reduce or eliminate the problems of breakage, edge chipping, overheating, fires, jammed equipment and the like which are so prevalent in the prior art.

I wish it to be understood that I do not desire to be limited to the exact details of construction shown and described, for obvious modifications can be made by a person skilled in the art.

I claim:

1. A lens grinding apparatus, comprising:

first mounting means mounting a lens blank substantially for linear motion on X, Y and Z orthogonal coordinate axes and for selective rotation on its X-axis;

first drive means selectively driving said lens blank in rotation;

second drive means indexing said lens blank along said Y-axis;

toroidal grinding means;

second mounting means mounting said grinding means for simultaneous oscillation and rotation in an X-Z plane; and template means superimposing cross radius and base radius lens parameters on said lens blank mounting means along said X-axis and constraining said lens blank into engagement with said grinding means in cooperation with said second drive means to generate an opthalmic lens surface on said lens blank;

said second drive means indexing said lens blank during selective rotation thereof along said Y-axis to cause said grinding means to traverse half the diameter of said lens blank and thereby generate a complete ophthalmic surface on said lens blank.

2. The invention defined in claim 1, wherein said template means comprises:

base and cross radius templates mounted in respective magazines;

a machine yoke mounting said lens blank, a base radius template and a cross radius template from said magazine for displacement in the X-Y plane of said apparatus in unison;

third drive means engaging said yoke mounted base radius template and constraining said lens blank and said yoke to follow the base radius contour thereof during Y-axis displacement by said second drive means; and fourth drive means oscillating in unison with said grinding means in said X-Z plane engaging said cross radius template and constraining said lens blank and said yoke to follow the cross radius contour thereof.

3. The invention defined in claim 2, wherein said template means further comprises:

fine grind base radius templates mounted in a third magazine; and fifth drive means interengaged with a fine grind template from said third magazine and said first mounting means for superimposing a base radius parameter on said lens blank in response to Y-axis displacement thereof by said second drive means; and wherein, when said fifth drive means is operative said lens blank is precluded from rotating.

4. The invention defined in claim 1, which further includes Z-axis drive means for superimposing a decentration displacement on said lens blank to provide a vertical prism therein.

5. The method of grinding an ophthalmic surface on a lens blank with a toroidal grinding means comprising:

mounting said toroidal grinding means for oscillation and rotation in a first common plane and oscillating and rotating same;

mounting said lens blank for selective rotation on an axis of rotation parallel with said first common plane and for orthogonal coordinate displacement in three directions including said axis of rotation as one coordinate axis;

superimposing base radius and cross radius parameters on said lens blank in a second plane orthogonal to said first plane and parallel to said axis of rotation; said cross radius parameter being generated in unison with the oscillation of said grinding means;

said base radius parameter being generated in response to displacement of said lens blank on a second axis orthogonal to said axis of rotation and in said second plane;

displacing said lens blank on said second axis no more than half the diameter of said lens blank while engaging said blank with said grinding means; and simultaneously rotating said lens blank during the last said displacement to provide a complete rough ground ophthalmic surface thereon.

6. The method of claim 5 wherein said last displacement is increased to no more than the diameter of said lens blank;

wherein said lens blank is kept from rotation; and wherein said base radius and cross radius parameters are superimposed on said rough ground ophthalmic surface in a Cartesian coordinate scan to provide a finished ground ophthalmic surface on said lens blank.

7. The method of grinding an ophthalmic lens from a lens blank comprising:

mounting and rotating a lens blank on a rotatable lens mounting pedestal;

mounting said pedestal for movement in three orthogonal axes one of which is parallel to the axis of rotation of said mounting pedestal;

rotating a grinding wheel on an axis parallel to a second of said orthogonal axis; and oscillating said grinding wheel in a plane parallel to the remaining one of said axes while engaged with said lens blank; and superimposing cross and base radius constraints on said lens blank along the axis of rotation of said blank while moving said blank pedestal along said second of said orthogonal axes.

* * * * *